United States Patent [19]

Tomlinson

[11] Patent Number: 4,655,602

[45] Date of Patent: Apr. 7, 1987

[54] TURBINE MIXER

[75] Inventor: Robert K. Tomlinson, Woodville, Australia

[73] Assignee: Monier Limited, Woodville, Australia

[21] Appl. No.: 810,508

[22] Filed: Dec. 19, 1985

[30] Foreign Application Priority Data

Dec. 20, 1984 [AU] Australia ..... PG8647

[51] Int. Cl.[4] ..... B28C 5/18

[52] U.S. Cl. ..... 366/56; 366/326

[58] Field of Search ..... 366/56, 59, 326, 308, 366/275, 266

[56] References Cited

U.S. PATENT DOCUMENTS

| | | | |
|---|---|---|---|
| 2,152,939 | 4/1939 | Wentworth | 198/165 |
| 2,663,228 | 12/1953 | Serpas | 92/22 |
| 2,991,051 | 7/1961 | Jones | 366/326 X |
| 3,358,973 | 12/1967 | Mitchell et al. | 366/56 X |
| 3,592,448 | 7/1971 | Stevenson | 366/56 |
| 4,060,167 | 11/1977 | Smith | 198/622 |
| 4,205,920 | 6/1980 | Vigano | 366/326 |
| 4,324,495 | 4/1982 | Martinez | 366/271 |

FOREIGN PATENT DOCUMENTS

| | | | |
|---|---|---|---|
| 20308 | of 1908 | United Kingdom | 366/56 |
| 873913 | 10/1981 | U.S.S.R. | 366/56 |

*Primary Examiner*—H. Hampton Hunter

*Attorney, Agent, or Firm*—Brown, Martin, Haller & Meador

[57] ABSTRACT

A mixer having a rotary drum which comprises a flexible member, an inner rotor with outstanding blades thereon, the flexible member, the inner rotor, and its blades all being of elastomeric material, the inner diameter of the flexible member being greater than the envelope diameter of the rotor blades, the mixer rotor being positionable within the flexible member with which its blades co-operate in the mixing of concrete, but being withdrawable therefrom for cleaning and maintenance purposes.

11 Claims, 4 Drawing Figures

TURBINE MIXER

This invention relates to a mixer which is useful as a concrete mixer, and in particular to a turbine mixer having a rotary drum.

BACKGROUND OF THE INVENTION

When large quantities of concrete are to be mixed, for example for the production of concrete blocks or tiles, it is necessary to use a very dry mix and this has associated with it a number of difficult practical problems. Firstly the mix tends to cake or "pack" on the beaters or blades of the mixer, and the mixing efficiency rapidly reduces as concrete builds up on the mixing surfaces.

It is already known that one of the most time consuming and dangerous jobs is the cleaning of the mixing surfaces, and heretofore use has been made of physically large batch mixers which are subject to the abovementioned disability, and which require cleaning, usually twice a day. This is a hazardous operation and some accidents have occurred. The cost of batch mixers is very high, and the energy consumption is also very high.

We have discovered that certain types of continuous mixers are capable of large throughputs with relatively small power inputs, are relatively small dimensionally, and are of low cost. For example, the reader may refer to the invention the subject of our U.S. patent application No. 626,699 dated July 2nd, 1984, wherein the use of a lug belt co-operating with a part loop surface of a base belt for concrete mixing resulted in a considerable improvement in concrete mixing, in throughput and in cost.

The main object of this invention is to provide a continuous mixer wherein the cleaning requirement is less than with the batch type mixer which is presently used in production factories, and wherein there is also an improvement in concrete mixing, in throughput and in cost, and wherein cleaning is facilitated.

BRIEF SUMMARY OF THE INVENTION

Briefly in this invention there is provided a mixer having a rotary drum which comprises a flexible member, an inner rotor with outstanding blades thereon, the flexible member, the inner rotor, and its blades all being of elastomeric material, the inner diameter of the flexible member being greater than the envelope diameter of the rotor blades, the mixer rotor being positionable within the flexible member with which its blades cooperate in the mixing of concrete, but being withdrawable therefrom for cleaning and maintenance purposes.

With this arrangement, the blades can be so orientated that they cause the concrete mix to move forwardly at a rate which is not constant, and this is found to provide an exceedingly high speed mixing rate. The amount of power required to operate the machine can be made quite small.

More specifically, the invention consists of a main frame and a sub-frame, an inner rotor carried by the sub-frame and journalled for rotation with respect thereto, and comprising blades radially outstanding from its outer surface, a rotary drum assembly carried by the main frame and journalled for rotation with respect thereto, and comprising a flexible member, said inner rotor, its said blades and said drum flexible member all being of elastomeric material, guide means guiding the sub-frame for movement with respect to the main frame between a first position wherein the inner rotor is within the drum flexible member with which its blades co-operate in the mixing of concrete and a second position wherein the inner rotor is withdrawn therefrom, first drive means on a said frame coupled to the inner rotor for effecting rotational drive thereof, and second drive means on the main frame coupled to the rotary drum for effecting rotational drive thereof.

The use of elastomeric material is found in itself to greatly facilitate the shedding of concrete which otherwise packs or builds up on surfaces within a mixer, but it is desired to reduce even more the building up of concrete on the surfaces than can be achieved by using fixed elastomeric material, as for example, an elastomeric sleeve cemented to the inner wall of the rotary drum, and in another aspect of this invention the inner member comprises an inflated body having a curved surface from which the blades project, and the drum flexible member is either an inner liner of the drum or an inflated annular member, so that there is a "live" effect which is found to be particularly effective in reducing adhesion of concrete to the surfaces.

When a production line is being fed with concrete from a concrete mixer, it is critical that any down time due to blockaging of the mixer should be a minimum, and in another aspect of this invention (not herein illustrated) the rotary drum assembly is supported by supporting wheels on a frame, and the frame comprises a swing away housing which, when released, enables immediate access to the rotary drum for maintenance purposes.

For continuous operation, clearly it is necessary for a mix to be fed continuously into the rotary drum assembly, and yet it is also necessary that the mixture which is fed into the drum assembly should be inhibited against spillage from the entry end, yet allow withdrawal of the rotor assembly, thereby leaving the discharge end open and free, and in a still further aspect of the invention, the entry end of the rotary drum assembly is provided with a part-conical ring which converges away from the rotary drum. With this arrangement, the rubber cone can retain particulate material within the drum and the rotor can have blades which wipe the inner surface of the trough during their traverse and thereby urge particulate material into the drum from the cone end and build up of particulate material which might result in spillage.

DETAILED DESCRIPTION OF THE PREFERRED EMBODIMENT

Figure 1:
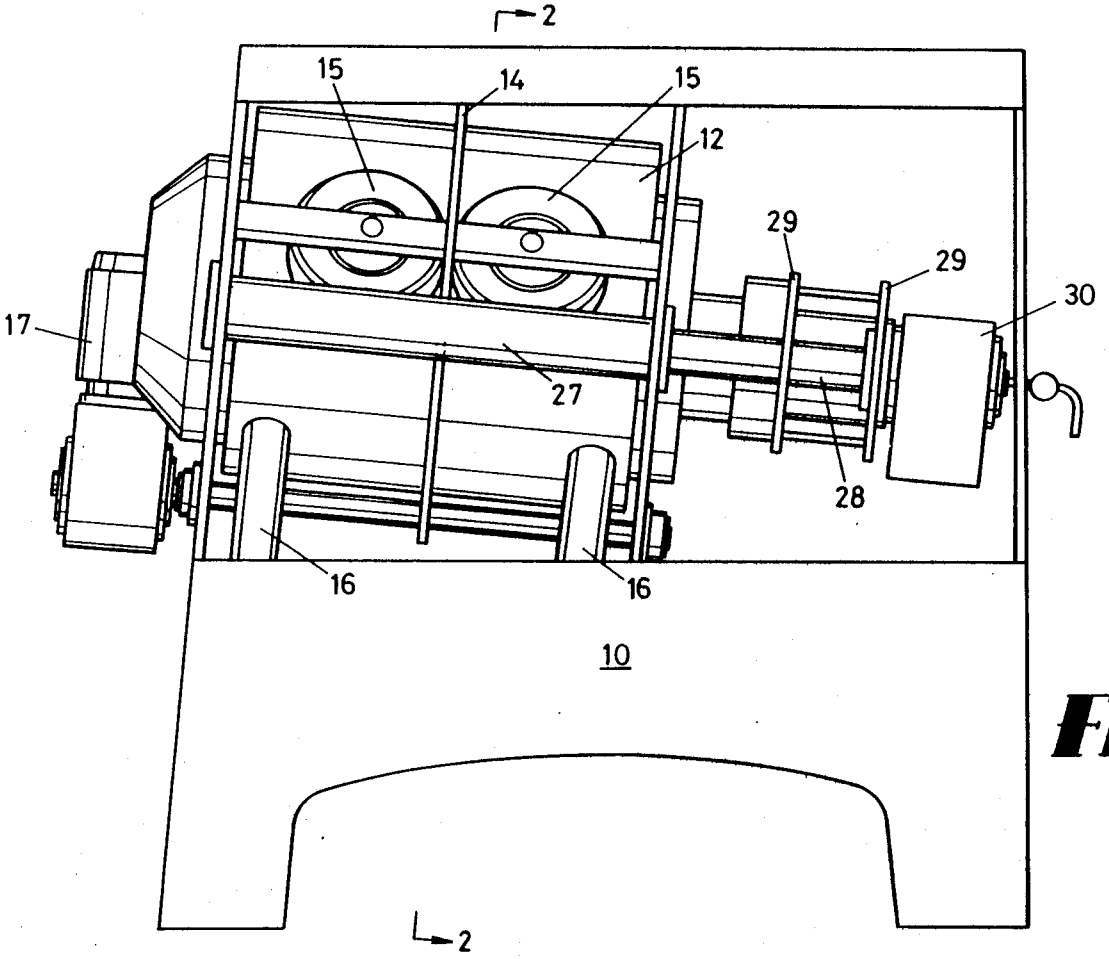
Figure 2:
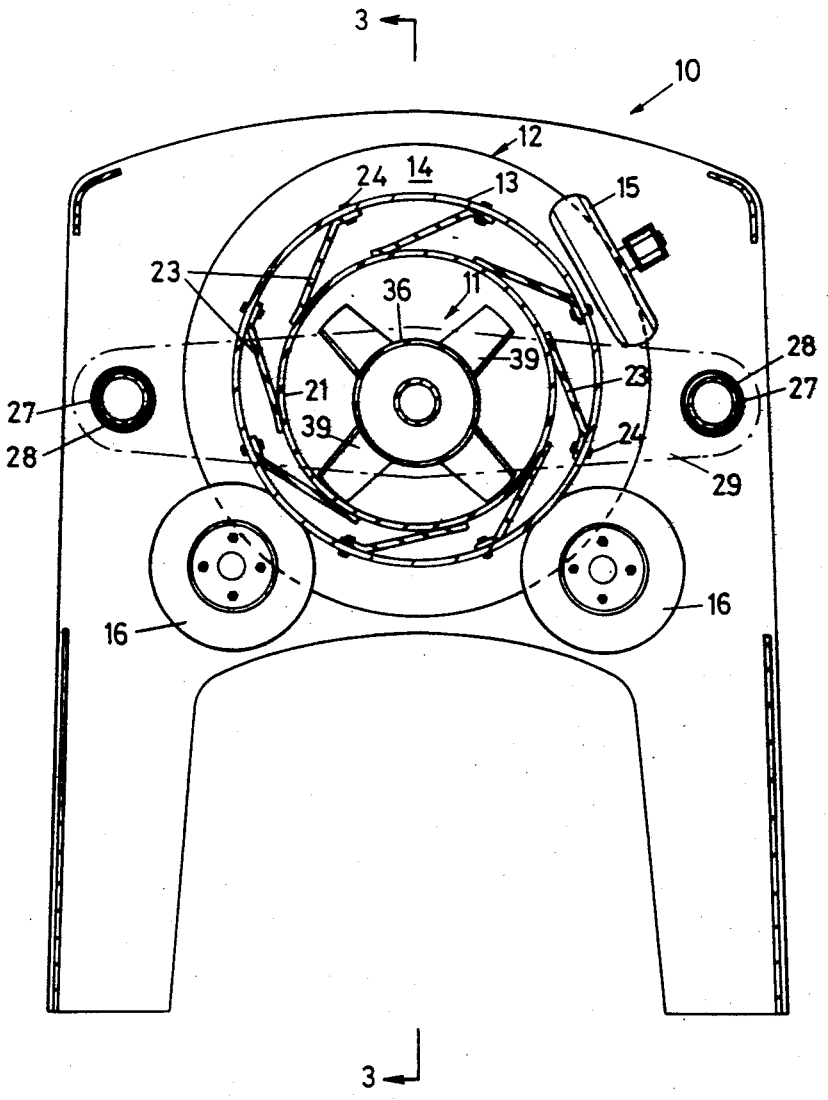
Figure 3:
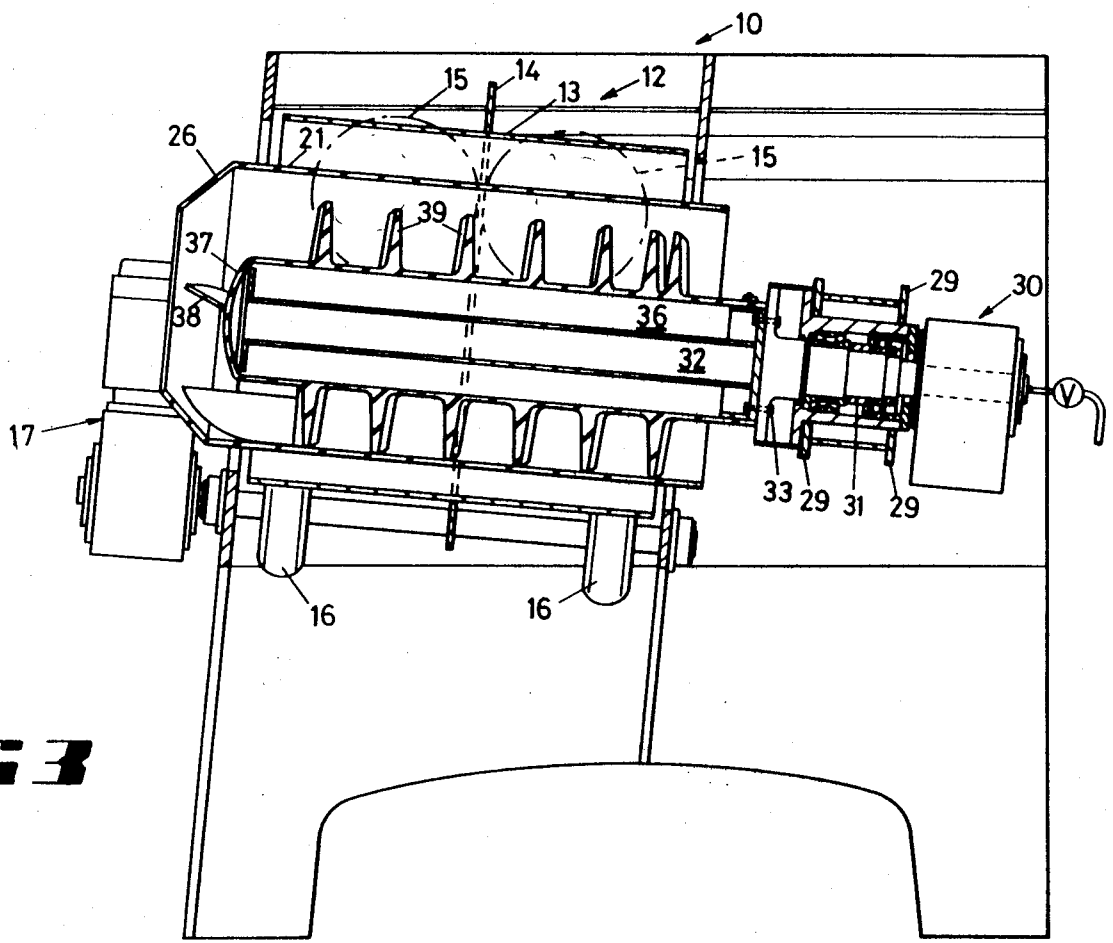
Figure 4:
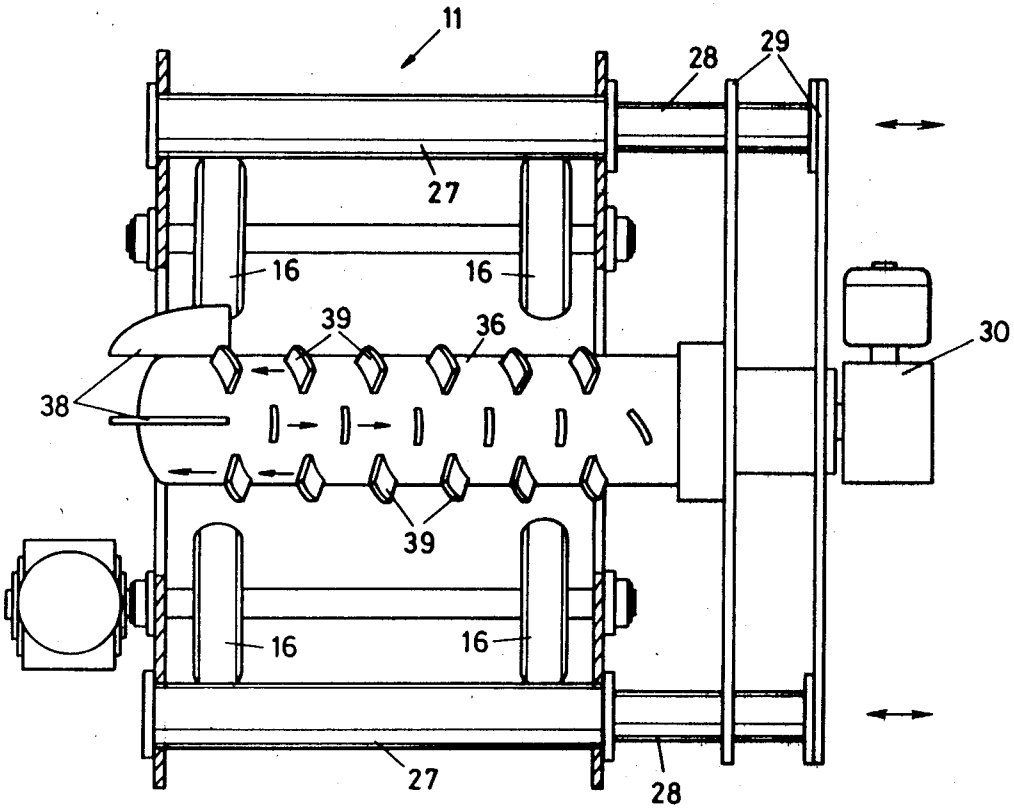

An embodiment of the invention is described hereunder in some detail with reference to, and is illustrated in, the accompanying drawings, in which FIG. 1 is a side elevation of a mixer, FIG. 2 is a cross-section on line 2—2 of FIG. 1, FIG. 3 is an elevational section on lines 3—3 of FIG. 2, and FIG. 4 is a sectional plan view of FIG. 3 showing the inner rotor and its sub-frame, the outer rotor assembly not being shown in this view.

In this embodiment a rotary drum type mixer 10 is a relatively small mixer, being provided with an inner rotor assembly 11 and a rotary drum assembly 12.

The rotary drum assembly 12 comprises a generally cylindrical outer drum 13 which has a centrally located outstanding circular flange 14 engaged by idler rollers 15 to inhibit axial movement, otherwise the drum being supported on two driven rollers 16 set at "4.30" and "7.30" (referred to the hour hand of a clock), these rollers being provided with rubber tyres and being driven by a motor and gearbox combination 17 for rotation of the drum. The drum 13 may be further retained in engagement with the rollers 16 (if required) by means of two additional guide rollers which are located at "10.30" and "1.30" (these locations being related to the hour hand of a clock for convenience of understanding). The two upper guide rollers, if used, are carried however on a swing-away frame housing, the swing-away frame housing being an inverted "U" part of the housing having a hinge extending longitudinally on one lower edge and a latching arrangement on the other lower edge, the arrangement being such that upon lifting up the swingaway frame housing, the rotary drum assembly is immediately exposed to an operator for maintenance purposes. Since this arrangement is not commonly used, it is not illustrated herein.

The rotary drum 13 is a steel drum which, as said, is driven by the rollers 16, but this contains a driven flexible member 21 being an annular liner of rubber or other elastomeric material.

In some embodiments of the invention, member 21 is inflated, but provides a generally cylindrical inner surface. On being inflated this inner surface is "live". In the embodiment illustrated herein, however, instead of use being made of inflation, the cylindrical liner 21 is connected to the outer drum 13 by a plurality of rubber straps 23. Each strap 23 is bolted to outer drum 24 by bolts 24, and vulcanised to the outer surface of the flexible liner 21. Each strap 23 is inclined with respect to the radius of the drum 13 and the liner 21, and the latter two members are generally concentric.

The entry end of the drum has secured to it a conical rubber lip (a "rubber cone") which converges beyond the entry end and this limits spillage from whatever charging means is used.

The rotary drum assembly 12 comprises an outer rotor, and the inner rotor assembly comprises a pair of hydraulic cylinders 27, the piston rods 28 of which extend beyond the entry end of the rotor assembly, and are joined by a transverse frame comprising a pair of spaced parallel plates 29 which between them support a motor/gearbox combination 30, and the gearbox output shaft 31 is secured to a central shaft 32 of the inner rotor assembly 11, by bolts 33, the central shaft being cantilevered. By actuation of the hydraulic cylinders 27, the whole rotor assembly can be withdrawn from the flexible liner 21 for cleaning purposes.

The inner rotor assembly 11 comprises an inner rotor 36 which is generally cylindrical but sealed at both ends. The projecting end is sealed by an end cap 37 and has end wiper blades 38 which wipe the inner surface of the part-conical lip 26, and a plurality of outstanding blades 39. All this part of the structure is of rubber, or elastomeric material with similar properties.

Low pressure air is introduced into inner rotor 36 through air hose 41, and caused by valve 'V' to pulsate alternately at about 1 p.s.i. and 3 p.s.i. (7 kPa and 21 kPa) to cause flexure of the cylindrical walls, which in turn causes shedding of concrete which might otherwise adhere. The outstanding blades 39 are inclined such that they lie in a helical direction, but the helix angle varies for different blades so that the progress of particulate material through the rotary drum assembly is not a steady flow, but rather a flow of varying velocity which causes effective mixing. Although the inner rotor 36 can be driven in the same rotational direction as a rotary drum 13, it is preferred to be driven in a contrary direction. It is also regarded as important that the rotary drum assembly should not be driven so fast that the particulate material is retained against the inner surface by centrifugal force, and that the inner rotor speed should be such that aeration of the mix does not occur.I As seen best in FIG. 2, the inner rotor rotates on an axis which is parallel to but displaced downwardly from the axis of rotation of the flexible inner liner 21, and at the bottom portion of their traverse, the blades 39 sweep the inner surface of the liner 21.

Also, as shown in FIG. 2, there is a central space beneath the rotary drum assembly 12, and this will accommodate one end of a conveyor belt (if required). Such a conveyor belt would then carry away the mixed material. less tendency for particulate material to build up and enables use to be made of a relatively small and therefore inexpensive mixer which nevertheless provides a very high throughput, and avoids the need for very large and expensive batch mixers.

In the event of blockage or other failure, the rotor and stator can be separated immediately and the rotor can be cleaned by hand with much less effort than a batch mixer which would otherwise be required for the same throughput of concrete. The cost is so low that it is feasible for a factory to be provided with a "stand by" mixer which can be used if the first mixer is required to be cleaned or to have maintenance work effected. However, maintenance is reduced to be much less than the maintenance required for batch mixers of the type previously used.

The claims defining the invention are as follows:

1. A concrete mixer comprising a main frame and a sub-frame, an inner rotor carried by the sub-frame and journalled for rotation with respect thereto, and comprising blades radially outstanding from its outer surface, a rotary drum assembly carried by the main frame and journalled for rotation with respect thereto, and comprising a flexible member, said inner rotor, its said blades and said drum flexible member all being of elastomeric material, guide means guiding the sub-frame for movement with respect to the main frame between a first position wherein the inner rotor is within the drum flexible member with which its blades co-operate in the mixing of concrete, and a second position wherein the inner rotor is withdrawn therefrom, first drive means on a said frame coupled to the inner rotor for effecting rotational drive thereof, and second drive means on the main frame coupled to the rotary drum for effecting rotational drive thereof.

2. A concrete mixer according to claim 1 wherein said first drive means is on said sub-frame and each said drive means comprises a motor and gearbox assembly.

3. A concrete mixer according to claim 2 wherein said inner rotor is generally cylindrical in shape but sealed at both ends, some at least of said blades being outstanding from the cylindrical surface of the inner rotor.

4. A concrete mixer according to claim 1 wherein said rotary drum assembly comprises a rigid drum and said flexible member comprises an annular elastomeric liner contained within the rigid drum, and a plurality of elastomeric straps extend between the liner and the drum and retain the liner generally coaxial with the drum.

5. A concrete mixer according to claim 4 wherein said rigid drum comprises an outstanding circular flange having side faces, rollers engaging the circular flange side faces and restraining the drum against displacement in an axial direction, and said second drive means comprise rubber-tyred wheels driven by a said motor and gearbox assembly and supporting the rigid drum.

6. A concrete mixer according to claim 1 wherein, upon operation, the drive means drive the inner rotor and rotary drum in opposite directions.

7. A concrete mixer according to claim 4 wherein said inner rotor has an axis of rotation parallel to but beneath the axis of rotation of the annular elastomeric liner and said outstanding blades sweep the inner surface of the liner during the lower part of their traverse.

8. A concrete mixer according to claim 1 wherein said radially outstanding blades are inclined so that they lie in a helical direction, but the helix angle varies for different blades.

9. A concrete mixer according to claim 4 further comprising an air hose in communication with the space within the inner rotor.

10. A concrete mixer according to claim 9 further comprising a valve associated with the air hose and operable to inflate the inner rotor alternately with air at differing pressures from a source of compressed air.

11. A concrete mixer according to claim 4 comprising a valve and air hose operable to inflate the inner rotor alternately with air at differing pressures from a source of compressed air.

* * * * *